United States Patent [19]

Yasuda

[11] 4,126,992

[45] Nov. 28, 1978

[54] STEM MECHANISM FOR A WATCH

[75] Inventor: Kazumasa Yasuda, Tokyo, Japan

[73] Assignee: Kabushiki Kaisha Daini Seikosha, Japan

[21] Appl. No.: 643,174

[22] Filed: Dec. 22, 1975

[30] Foreign Application Priority Data

Dec. 26, 1974 [JP] Japan ..... 50-1005

[51] Int. Cl.[2] ..... G04B 37/00

[52] U.S. Cl. ..... 58/88 B; 58/85.5; 58/90 B; 58/63

[58] Field of Search ..... 58/23 R, 23 BA, 50 R, 58/63 R, 73, 85.5, 88 B

[56] References Cited

U.S. PATENT DOCUMENTS

| | | | |
|---|---|---|---|
| 2,985,997 | 5/1961 | Rabinow | 58/85.5 |
| 3,678,682 | 7/1972 | Miyasaka et al. | 58/99 |
| 3,765,164 | 10/1973 | Esselborn | 58/85.5 |
| 3,846,971 | 11/1974 | Ho et al. | 58/50 R |
| 3,849,977 | 11/1974 | Hirose et al. | 58/85.5 |
| 3,874,162 | 4/1975 | Boxberger et al. | 58/85.5 |
| 3,935,700 | 2/1976 | Van Haaften | 58/85.5 |
| 3,978,296 | 8/1976 | Moriya et al. | 58/23 X |
| 4,034,553 | 7/1977 | Wuthrich | 58/88 B |

*Primary Examiner*—Robert K. Schaefer
*Assistant Examiner*—Vit W. Miska
*Attorney, Agent, or Firm*—Robert E. Burns; Emmanuel J. Lobato; Bruce L. Adams

[57] ABSTRACT

A winding stem mechanism including a winding shaft having a detent portion comprised of a pair of annular peripheral recesses with an annular step portion therebetween, and a pair of annular stops each adjacent a respective one of the recesses, and mounted for rotation and for being axially slidable. A resilient spring-like member normally engages a first of the recesses to define a normal position of the shaft and when the shaft travels in a first axial direction the spring-like member climbs the annular step portion to engage the second of the recesses. When the shaft travels in a second axial direction it pushes the annular stop adjacent the first recess to flex the spring-like member to permit the shaft to travel to a second operating position and flex in a direction effective to bias the shaft back from the second operating position to the normal position when the shaft is released.

3 Claims, 11 Drawing Figures

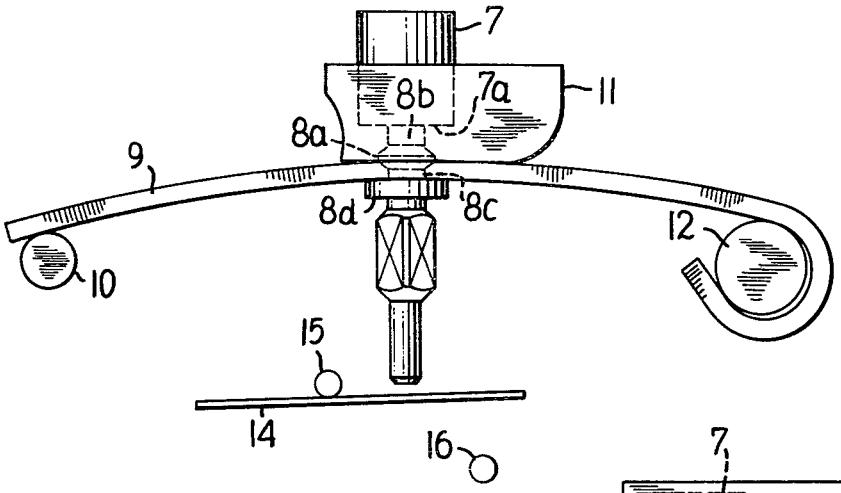
FIG. 6
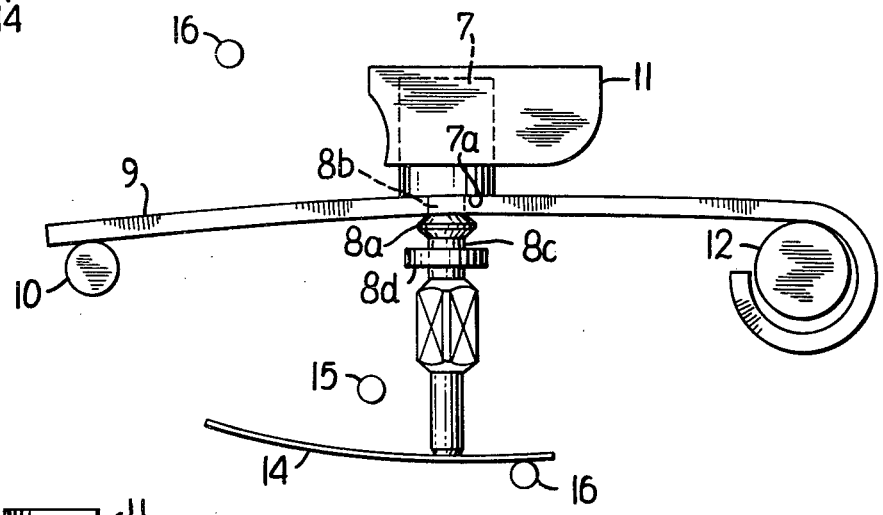
FIG. 7
FIG. 5
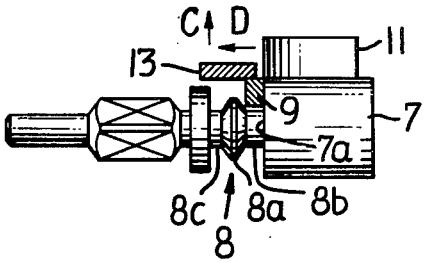
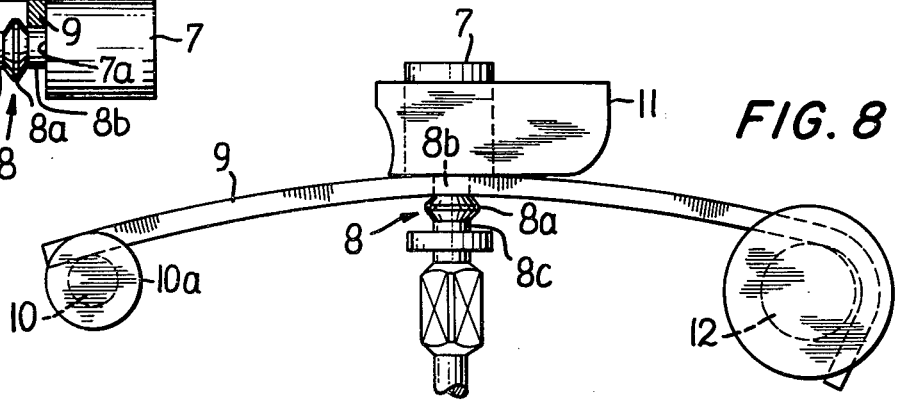
FIG. 8
FIG. 9
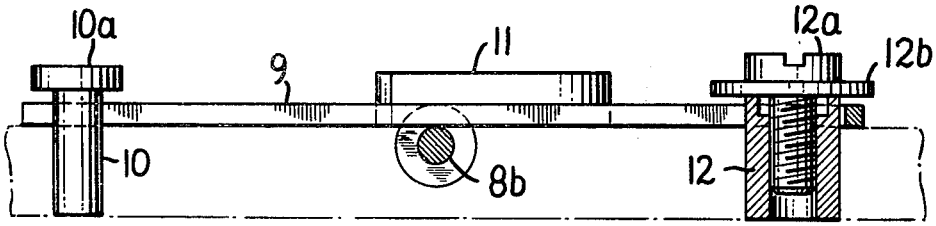

STEM MECHANISM FOR A WATCH

BACKGROUND OF THE INVENTION

This invention relates to a stem mechanism able to perform a switching operation and pushing operation.

In the conventional type stem mechanism, a hands adjustment, a date adjustment and a weak adjustment are operated by the operation of the winding shaft whereby the stem mechanism has a complicated construction because of the additional mechanism and increased number of parts.

Generally in a watch the stem mechanism has to be mounted in as small a space as possible according to the restricted space of the other mechanism.

FIG. 1(A), 1(B) and FIG. 2(A), 2(B) show respectively the conventional stem mechanisms, these mechanism are employed instead of the conventional trigger-piece and setting lever.

In FIG. 1(A), (B), the winding shaft supporting member 1 is mounted on the base plate by the screw bolt 2, and said winding shaft supporting member 1 develops a spring force radially of said winding shaft 4 by the bent portion of said supporting member 1 which is inserted in the hole 3 of said base plate.

Said winding shaft 4 is positioned by the bent portion 1*b* of said winding shaft supporting member 1 engaged with the recess portion 5*a* of the detent portion 5. The winding shaft supporting member 1 is moved when said bending portion 1*b* climbs over the protrusive portion or annular step 5*b* on the detent portion 5 by the pulling of said winding shaft 4. When said bending portion 1*b* falls into said recess portion 5*c*, said winding stem supporting member is positioned at a secondary step portion. However, in said stem mechanism, it is difficult to push said winding shaft without the operation of said detent portion 5.

In FIG. 2(A), (B), structure for the pushing mode of operation is added to the stem mechanism. The stem shaft 4 is positioned by the winding shaft supporting member 1 as indicated in FIG. (A), (B), and a force in the direction of arrow mark B is applied to said supporting member 1 by the restoring spring member 6.

The long recess portion 5*d* formed in the detent portion 5 of said winding shaft 4 for guiding said bent portion 1*b* of said winding shaft supporting member 1 when said winding shaft 4 is pushed whereby the switching operation of said winding shaft 4 and the pushing operation of said winding shaft 4 can occur. However, according to the embodiment in FIG. 2, it is necessary to provide spring member 6 for automatically restoring said winding shaft 4 in the pushing mode of operation. Further relating to the mounting space required for said spring member 6, the space loss becomes larger because of the guiding recess portion 5*d*.

OBJECT OF THE INVENTION

The present invention aims to eliminate the above noted difficulty and insufficiency, and therefore it is the primary object of the present invention to provide a stem mechanism able to be operated in the pushing mode.

Further object of the present invention is to provide the stem mechanism easily mounted in a small space.

SUMMARY OF THE INVENTION

The stem mechanism according to the invention includes a winding shaft having a detent portion, and a spring member. The detent portion has a plurality of step portions, and said spring member be able to climb over said step portions whereby said winding shaft is positioned according to which of the step portions the spring member is between and is able to operate by axial travel. The detent portion has stops at its opposite ends and the spring member is bent or flexed by the stop during the pushing operation of said winding shaft from a position determined by the spring member engaging between ones of the step portions.

BRIEF DESCRIPTION OF THE DRAWINGS

The above mentioned and further objects, features and advantages of the present invention will become more apparent from the following description when taken in connection with the accompanying drawing which show two preferred embodiments and wherein:

FIG. 5 shows the side view of the stem mechanism of the present invention illustrated in FIG. 4, FIGS. 6 and 7 show a plan view for explanating the operation of the stem mechanism of the present invention, FIG. 8 shows a plan view of another embodiment of the stem mechanism of the present invention, FIG. 9 shows the cross sectional view of the stem mechanism illustrated in FIG. 8.

DETAILED DESCRIPTION OF THE INVENTION

Figure 1A:
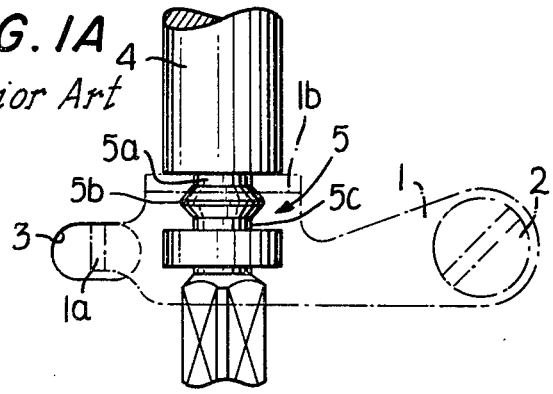
FIG. 1A Prior Art
FIG. 1 shows a plan view and the cross sectional view of the conventional stem mechanism.
Figure 1B:
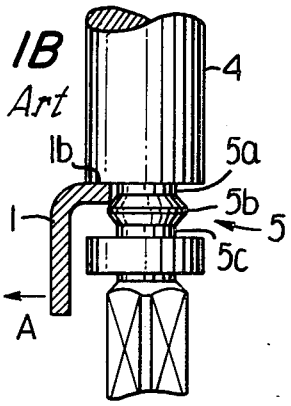
FIG. 1B Prior Art
Figure 2A:
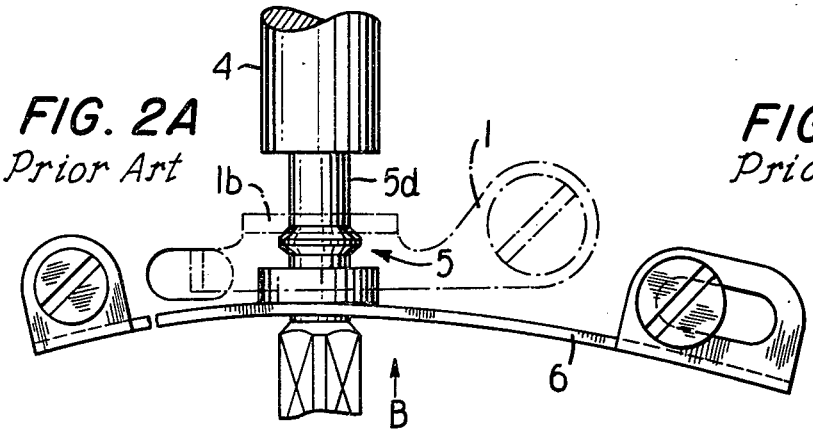
FIG. 2A Prior Art
FIG. 2 shows a plan view and the cross sectional view of another conventional stem mechanism.
Figure 2B:
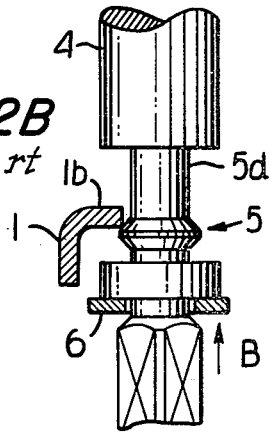
FIG. 2B Prior Art
Figure 3:
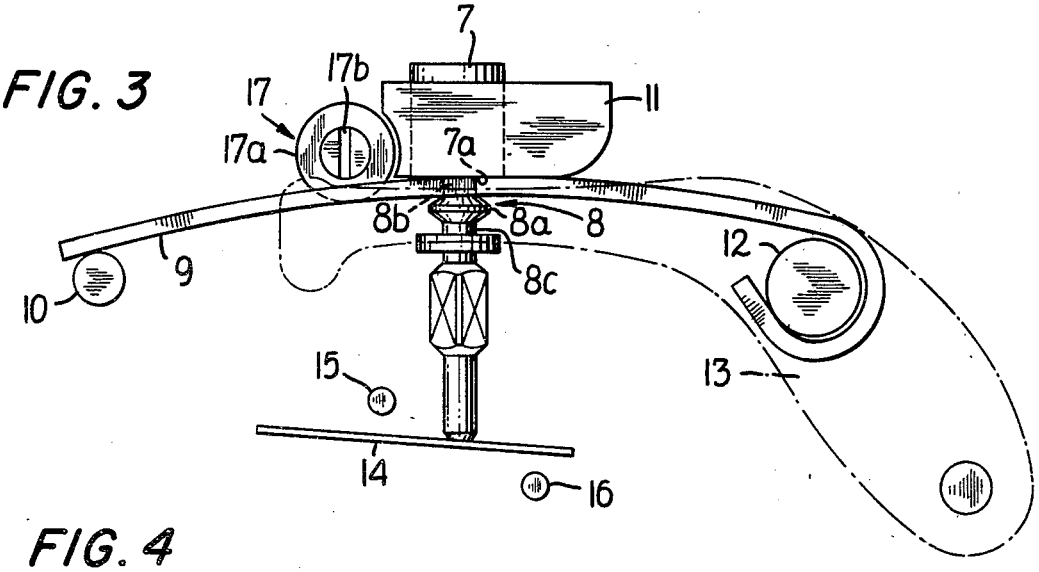
FIG. 3 shows a plan view of the stem mechanism of the present invention.
Figure 4:
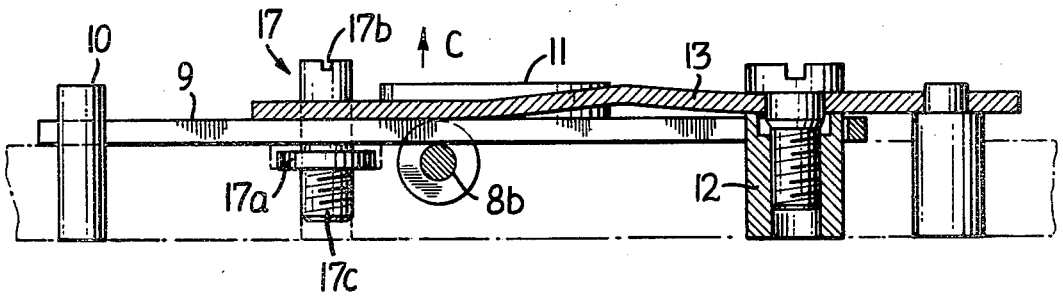
FIG. 4 shows the cross sectional view of the step mechanism illustrated in FIG. 4.

This invention relates to a stem mechanism for an electronic watch. Referring now to the embodiment of the present invention illustrated in the accompanying drawings. FIGS. 3, 4 and 5 show the stem mechanism of the present invention set to the normal position wherein the stem is at a normal position.

The annular protusion 8*a* on the winding shaft 7 is part of a detent portion 8, which further includes the recess portions 8*b* and 8*c* respectively positioned before and behind the annular protrusion or step portion 8*a*. The spring member 9 is engaged with said recess portion 8*b* of said detent portion 8, and is pushed or biased toward the large portion or annular stop 7*a* of said winding shaft 7 due to a primary bending condition caused by the position members 10, 11 and 12, and further is usually pushed to engage the detent portion 8 by the supporting member 13. Positon member 11 includes mounting means mounting said shaft for rotation and for being axially slidable.

Numeral 14 is the contact spring member, numeral 15 and 16 are the contact members, and said contact members 15 and 16 are separated from each other and positioned to contact said contact spring member 14.

Referring now to the operation of the above noted embodiment of the present invention illustrated in the accompanying drawings, FIG. 6 illustrates pulling said winding shaft from the condition indicated in FIG. 3 to FIG. 5 whereby said spring member 9 overcome or climbed over said annular protrusion 8*a* of said detent portion 8 in the direction of the arrow mark C, and engaged said recess portion 8*c*. Then said winding shaft is positioned by the flange or annular stop 8d of said detent portion 8. Said contact spring member 14 contacts with the contact 15 whereby the first operating position is attained as illustrated in FIG. 6. As another example, if there is a plurality of annular recesses in said detent portion 8, the number of said protrusive portion 8a is increased and the number of the operation positions is increased.

When said winding shaft 7 was pushed from the normal position said spring member 9 is pushed by the large portion 7a of said winding shaft 7 whereby said spring member 9 bends in the direction of the arrow mark "D", and said winding shaft 7 receives a spring restoration force directed opposite the direction of the arrow mark "D". This is the second operation position in which said contact spring member 14 contacts with the contact 16 whereby a secondary operation, for example lighting, is attained, when said winding shaft 7 is pushed sufficiently as indicated in FIG. 7.

When the pushing force applied to said winding shaft 7 is released, said winding shaft 7 is automatically restored to the normal position in which said contact spring member 14 is spaced from the contact 16.

FIG. 8 and FIG. 9 show the other embodiment of the invention which has mode of operation the same as the embodiment illustrated in FIG. 3 to FIG. 7. However, in this embodiment the flange 10a is mounted on said position member 10, and the other flange member 12b is mounted on the screw bolt 12a mounted on said position member 12 whereby said spring member 9 is supported by the flanges. Therefore, the number of parts can be reduced.

In the first described embodiment, the electrical switching operations occur at the first and second operating positions, however it is possible to effect hand adjustment and date adjustment at the first and second operating positions.

In pulling out the winding shaft 7, it is necessary to lift the spring member 9 in the direction of the arrow mark "C" and disconnect the gear coupling with the detent portion 8.

In the first described embodiment, the screw bolt 17 for pulling the winding shaft has a flange portion 17a inserted under said spring member 9. The screw bolt 17 is moved by the screw portion 17c, and said flange portion 17a lifts the spring member 9 thereby disconnecting the gear coupling with the winding shaft 7.

The above described construction relates to the structure for the pulling operation of the winding shaft from the upper side shown in FIG. 4. It is also possible to lift the spring member 9 by using a setting lever of the conventional type instead of said screw bolt 17.

Further, it is possible to pull the winding shaft without increasing the number of parts by shaping the hole through a part of the base plate which receives said screw bolt 17 so that pushing the spring member 9 relative to said hole allows pulling of the winding shaft.

According to the present invention, said spring member 9 determines the position of said winding shaft in switching from the normal position to the first operating position. Further in the pushing operation, said spring member acts to restore said winding shaft to the normal position. Therefore, the number of the parts becomes fewer, the construction is very simple, and assembly is very easy. Furthermore, it is possible to obtain a watch having a small shape and a winding stem mechanism having the pushing mode of operation.

What is claimed is:

1. A winding stem mechanism comprising, in combination:

a winding shaft having a detent portion comprised of a pair of annular peripheral recesses with an annular step portion therebetween, and a pair of annular stops each adjacent a respective one of said recesses;

a resilient spring-like member normally engaged with a first of said recesses to define a normal position of said shaft; and mounting means mounting said shaft for rotation and for being axially slidable, wherein axial travel of said shaft in a first axial direction is effective to cause said spring-like member to climb said annular step portion and engage the second of said recesses and the annular stop adjacent thereto to define a first operating position of said shaft, and wherein axial travel of said shaft in a second axial direction is effective to push the annular stop adjacent said first recess to flex said spring-like member to permit said shaft to travel to a second operating position and flex in a direction effective to bias said shaft in said first axial direction back from said second operating position to said normal position when said shaft is released.

2. A winding stem mechanism according to claim 1 further comprising: a contact spring member and a pair of contacts comprising a switch actuated by said winding shaft, wherein said contact spring member and said contacts are positioned relative to said winding shaft so that said contact spring is in contact with a first of said contacts when said winding shaft is at said first operating position, so that said winding shaft engages and biases said contact spring to disengage said first contact when said winding shaft is in said normal position, and so that said winding shaft engages and biases said contact spring to engage the other contact when said winding shaft is in said second operating position.

3. A winding stem mechanism comprising, in combination:

a winding shaft having a detent portion comprised of a plurality of annular peripheral recesses with annular step portions interposed between successive ones of said annular recesses, and a pair of annular stops each adjacent a respective one of said recesses at opposite ends of said plurality of annular recesses;

mounting means mounting said shaft for rotation and for being axially slidable to permit said shaft to travel in opposed axial directions; and a resilient spring-like member engaging a recesses of said detent portion to fix the axial position of said shaft to define a shaft operating position, said spring-like member being sufficiently resilient to climb over an annular step portion adjacent a recess with which said spring is engaged when a sufficient axial force is applied to said shaft whereby said shaft is positionable with a plurality of operating positions each determined by the engagement of said spring-like member with a respective one of said annular recesses, and said spring-like member being sufficiently resilient to flex when said shaft travels axially so that one of said stops bears against said spring-like member and biases said spring-like member to permit said shaft to travel in an axial direction to an operating position beyond the operating positions defined by said annular recesses with said spring-like member flexed to return said shaft to the operating position defined by one of said annular recesses adjacent said one of said stops when said shaft is released.

* * * * *